US009206635B1

(12) United States Patent
Lin

(10) Patent No.: US 9,206,635 B1
(45) Date of Patent: Dec. 8, 2015

(54) DOOR CLOSING DEVICE

(71) Applicant: Percy Cheng-Ching Lin, Dou-Liu (TW)

(72) Inventor: Percy Cheng-Ching Lin, Dou-Liu (TW)

( * ) Notice: Subject to any disclaimer, the term of this patent is extended or adjusted under 35 U.S.C. 154(b) by 0 days.

(21) Appl. No.: 14/332,440

(22) Filed: Jul. 16, 2014

(51) Int. Cl.
*E05F 3/02* (2006.01)
*E05F 1/10* (2006.01)
*E05F 1/00* (2006.01)

(52) U.S. Cl.
CPC ..... *E05F 1/002* (2013.01)

(58) Field of Classification Search
CPC ... Y10T 16/281; Y10T 16/299; Y10T 16/286; Y10T 16/27; Y10T 16/56; Y10T 16/585; Y10T 16/568; Y10T 16/62; Y10T 16/17; Y10T 292/301; Y10T 292/304; Y10T 292/285; Y10T 292/289; E05Y 2900/132; E05Y 2201/21; E05Y 2201/218; E05F 3/00; E05F 3/104; E05F 3/108; E05F 3/02; E05F 3/04; E05F 3/06; E05F 3/08; E05F 3/22; E05F 1/1016; E05F 1/1091; E05F 3/221
See application file for complete search history.

(56) References Cited

U.S. PATENT DOCUMENTS 3,105,264 A * 10/1963 Truhon ..... 16/66
4,194,264 A * 3/1980 Stoffregen ..... 16/52
5,048,150 A * 9/1991 Guerin ..... 16/49
5,592,780 A * 1/1997 Checkovich ..... 49/386
5,630,248 A * 5/1997 Luca ..... 16/71
5,832,562 A * 11/1998 Luca ..... 16/71
5,842,255 A * 12/1998 Luca ..... 16/51
6,615,449 B1 * 9/2003 Alvarez ..... 16/66
6,634,057 B2 * 10/2003 Wartian ..... 16/66
6,634,058 B1 * 10/2003 Lin ..... 16/66
6,910,302 B2 * 6/2005 Crawford ..... 49/379
7,134,168 B1 * 11/2006 Qing ..... 16/80
8,307,495 B1 * 11/2012 Berkseth ..... 16/66
8,661,616 B1 * 3/2014 Luca ..... 16/66
2003/0126716 A1 * 7/2003 Lin ..... 16/66
2003/0226235 A1 * 12/2003 Hodson ..... 16/66
2006/0272124 A1 * 12/2006 Wartian ..... 16/66
2007/0234509 A1 * 10/2007 Etlicher ..... 16/66
2012/0167340 A1 * 7/2012 Zhang ..... 16/65
2012/0260459 A1 * 10/2012 Wu ..... 16/82

FOREIGN PATENT DOCUMENTS

CN 102134945 A * 7/2011

* cited by examiner

*Primary Examiner* — Chuck Mah
(74) *Attorney, Agent, or Firm* — Trop Pruner & Hu, P.C.

(57) ABSTRACT

A door closing device includes a cylinder body, a piston rod having one end extending out the cylinder body, and a locking unit including a casing, and a locking ring and an abutment member both disposed in the casing. The locking ring is disposed around the piston rod and is movable between inclined and non-inclined positions, where the locking ring engages and disengages the piston rod, respectively. A press unit is disposed on the casing and is movable between a pressed position, where the press unit presses the locking ring to move to the inclined position, and an unpressed position, where the press unit moves away from the locking ring. The abutment member abuts against the locking ring to keep the locking ring in the inclined position when the press unit is in the unpressed position.

12 Claims, 9 Drawing Sheets

DOOR CLOSING DEVICE

BACKGROUND OF THE INVENTION

1. Field of the Invention

This invention relates to a door closing device, and more particularly to a door closing device that can retain a door at a desired open position and that can close the door automatically.

2. Description of the Related Art

Referring to FIG. 1, a conventional door closing device is shown to include a cylinder 11 having one end connected to a door frame (not shown) of a door (not shown), a piston rod 12 having one end extending out of the cylinder 11 and connected to the door, and a latch 13 movably sleeved on the piston rod 12. A restoring force is stored inside the cylinder 11 for automatic closing of the door. To position the door at a desired opening angle, the latch 13 is pushed to abut a lower portion thereof against an end periphery of the cylinder 11 so that a portion of the piston rod 12 which is pulled out of the cylinder 11 can engage a hole in the latch 13, thereby retaining the door at the desired opening angle. To close the door, a force is exerted on the door and the latch 13 is pushed to move the lower portion thereof away from the end periphery of the cylinder 11. Through the restoring force stored inside the cylinder 11, the door can close automatically. However, the latch 13 deviates easily and cannot accurately retain the door at the desired open position. Further, because the latch 13 is exposed, injury to the user's hand easily occurs.

Referring to FIG. 2, another conventional door closing device is shown to include a cylinder 21 having one end connected to a doorframe (not shown) of a door (not shown), a piston rod 22 having one end extending through the cylinder 21 and connected to the door, a latch 23 sleeved on the piston rod 22, a lever 24 connected to the latch 23, and a restoring spring 25 abutting between an end periphery of the cylinder 21 and the latch 23. A restoring force is stored inside the cylinder 21 for automatic closing of the door. To position the door at a desired opening angle, one of the user's hands pushes the door to an opening angle, while the other hand of the user pushes the lever 24 so that the latch 23 engages the piston rod 22, thereby retaining the door at the desired opening angle. To close the door, a force is exerted on the door, and, through the restoring spring 25 and the restoring force in the cylinder 21, the door closes automatically. However, both hands of the user are required to open the door, so that the conventional door closing device is inconvenient to use.

SUMMARY OF THE INVENTION

Therefore, the object of the present invention is to provide a door closing device that can easily and safely retain a door at a desired open position and that can close the door automatically.

According to this invention, a door closing device comprises a cylinder, a locking unit and a press unit. The cylinder includes a cylinder body having a fixed end and a free end opposite to the fixed end, and a piston rod axially movable in the cylinder body and having one end extending out of the free end. The locking unit includes a casing disposed around the piston rod and on the free end of the cylinder body, and a locking ring and an abutment member both disposed in the casing. The locking ring is disposed around the piston rod and is movable between an inclined position, where the locking ring is oblique to and engages the piston rod, and a non-inclined position, where the locking ring disengages the piston rod. The press unit is disposed on the casing and is movable between a pressed position, where the press unit presses the locking ring to move to the inclined position, and an unpressed position, where the press unit moves away from the locking ring. The abutment member abuts against the locking ring to keep the locking ring in the inclined position when the press unit is in the unpressed position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
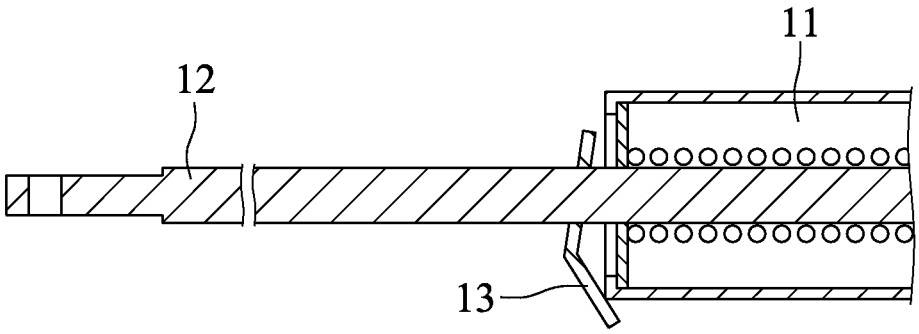
FIG.1 PRIOR ART
FIG. 1 is a fragmentary sectional view of a conventional door closing device.
Figure 2:
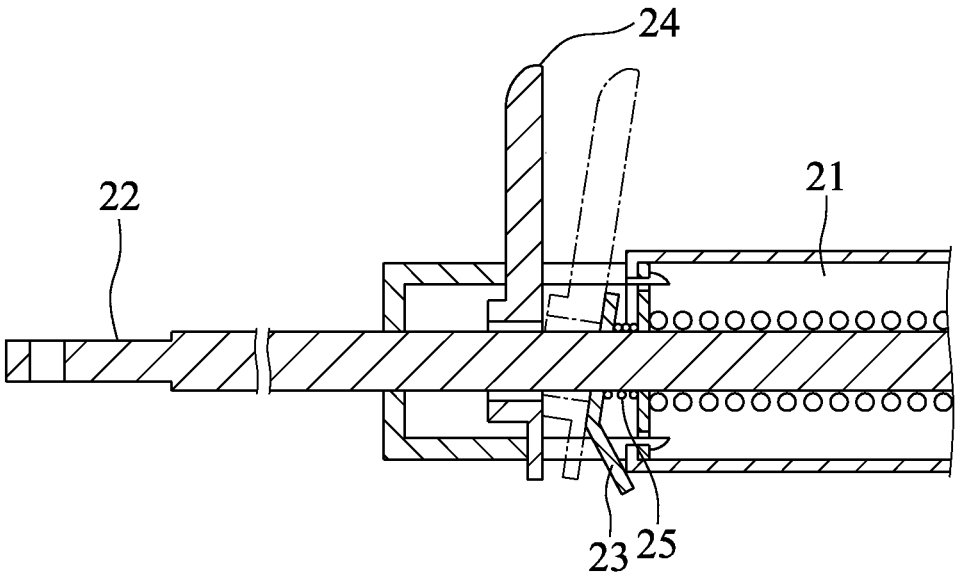
FIG.2 PRIOR ART
FIG. 2 is a fragmentary sectional view of another conventional door closing device.
Figure 3:
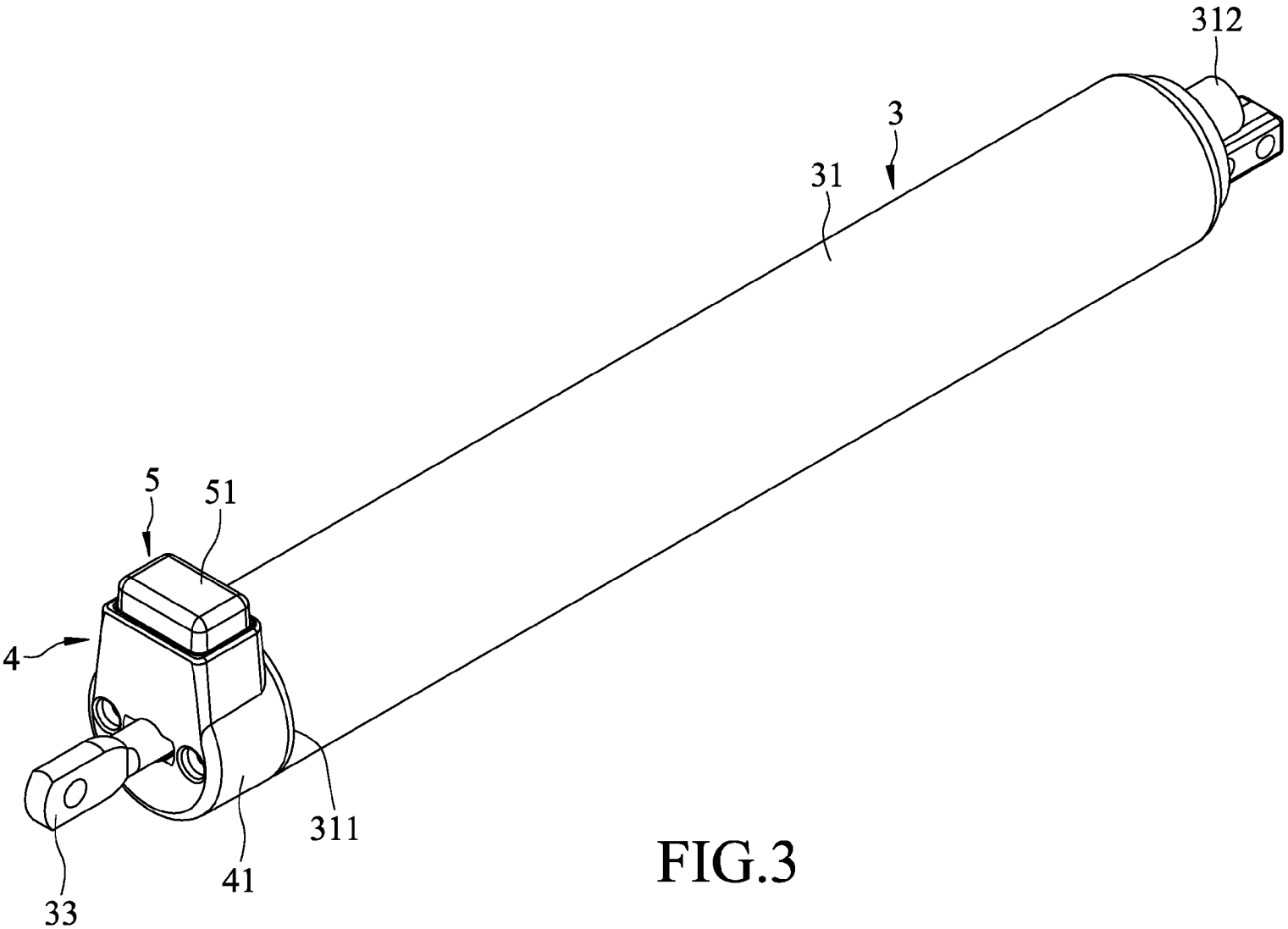
FIG. 3 is a perspective view of a door closing device according to the preferred embodiment of this invention.

Referring to FIGS. 3 to 10, a door closing device according to the preferred embodiment of this invention is suitable for installation between a door (not shown) and a door frame (not shown), and comprises a cylinder 3, a locking unit 4 and a press unit 5.

The cylinder 3 includes a cylinder body 31, a support member 32 and a piston rod 33. The cylinder body 31 extends in a longitudinal direction (X), and has a fixed end 312, and a free end 311 opposite to the fixed end 312. The fixed end 312 is connected to one of the door and the door frame. The support member 32 is disposed in the free end 311, and has a main body 321, a through slot 323 formed in the main body 321 for extension of the piston rod 33 therethrough, and two diametrically spaced-apart support posts 322. The main body 321 defines a receiving space 324 communicating with the through slot 323. The support posts 322 are formed in and extend out of the receiving space 324, and are substantially parallel to the piston rod 33. The piston rod 33 is axially movable in the cylinder body 31, and has one end extending through the through slot 323, the receiving space 324 and out of the free end 311 of the cylinder body 31. The end of the piston rod 33 that extends out of the cylinder body 31 is fixed to the other one of the door and the door frame.

Figure 4:
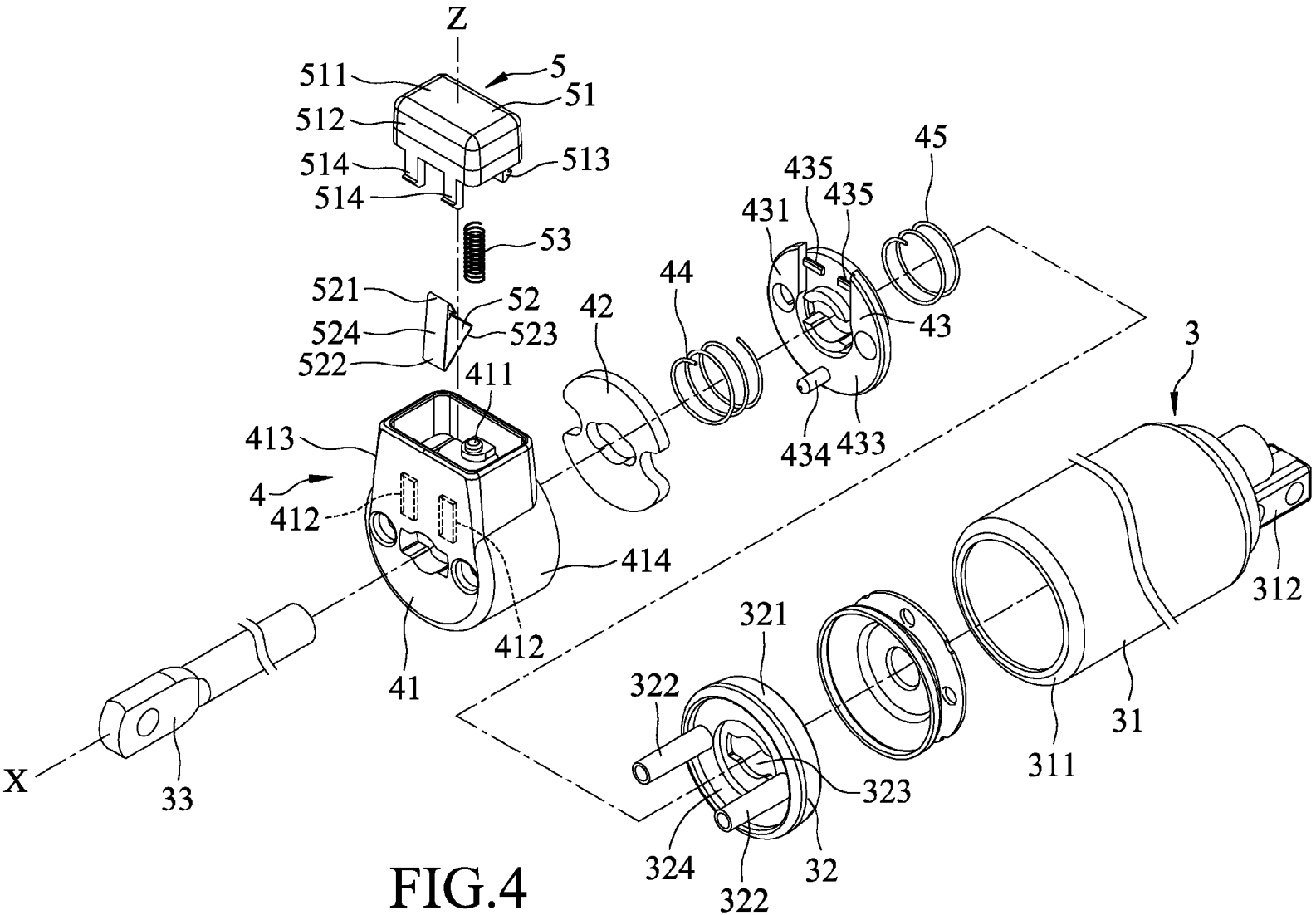
FIG. 4 is an exploded perspective view of the preferred embodiment.
Figure 5:
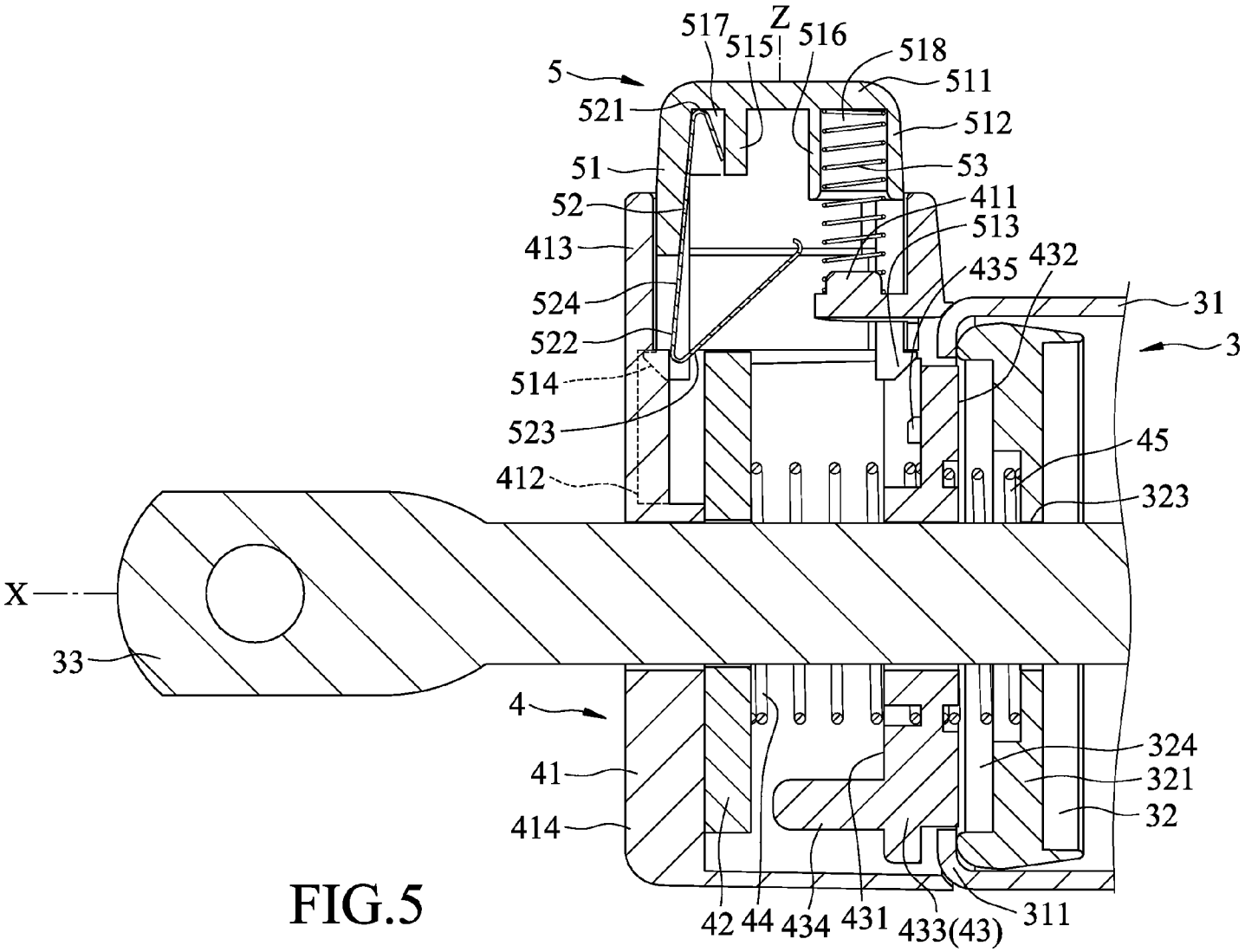
FIG. 5 is an enlarged fragmentary sectional view of the preferred embodiment, illustrating a press unit in a unpressed position.

With reference to FIGS. 4 and 5, the locking unit 4 includes a casing 41 disposed on the free end 311 of the cylinder body 31, and a locking ring 42, an abutment member 43, a first biasing member 44 and a second biasing member 45 all accommodated in the casing 41. The first biasing member 44 has two opposite ends respectively abutting against the abutment member 43 and the locking ring 42, and is used for biasing the locking ring 42 away from the abutment member 43. The second biasing member 45 has one end abutting against the abutment member 43 opposite to the first biasing member 44, and the other opposite end abutting against the main body 321 for biasing the abutment member 43 toward the locking ring 42. The second biasing member 45, the abutment member 43, the first biasing member 44, the locking ring 42 and the casing 41 are sequentially sleeved around the piston rod 33. The abutment member 43, the locking ring 42 and the casing 41 are further mounted on the support posts 322.

The casing 41 has an abutment arm 411 extending inwardly from an inner surface thereof, and two spaced-apart slide grooves 412 formed in the inner surface opposite to the abutment arm 411. To clearly understand this embodiment, the casing 41 is divided into a first portion 413 which is radially spaced apart from the piston rod 33, and a second portion 414 penetrated by the piston rod 33 and surrounding the piston rod 33. The abutment arm 411 is located on the first portion 413, while the slide grooves 412 are located on the second portion 414. The locking ring 42, the first biasing member 44, the abutment member 43 and the second biasing member 45 are sequentially accommodated in the second portion 414.

Figure 6:
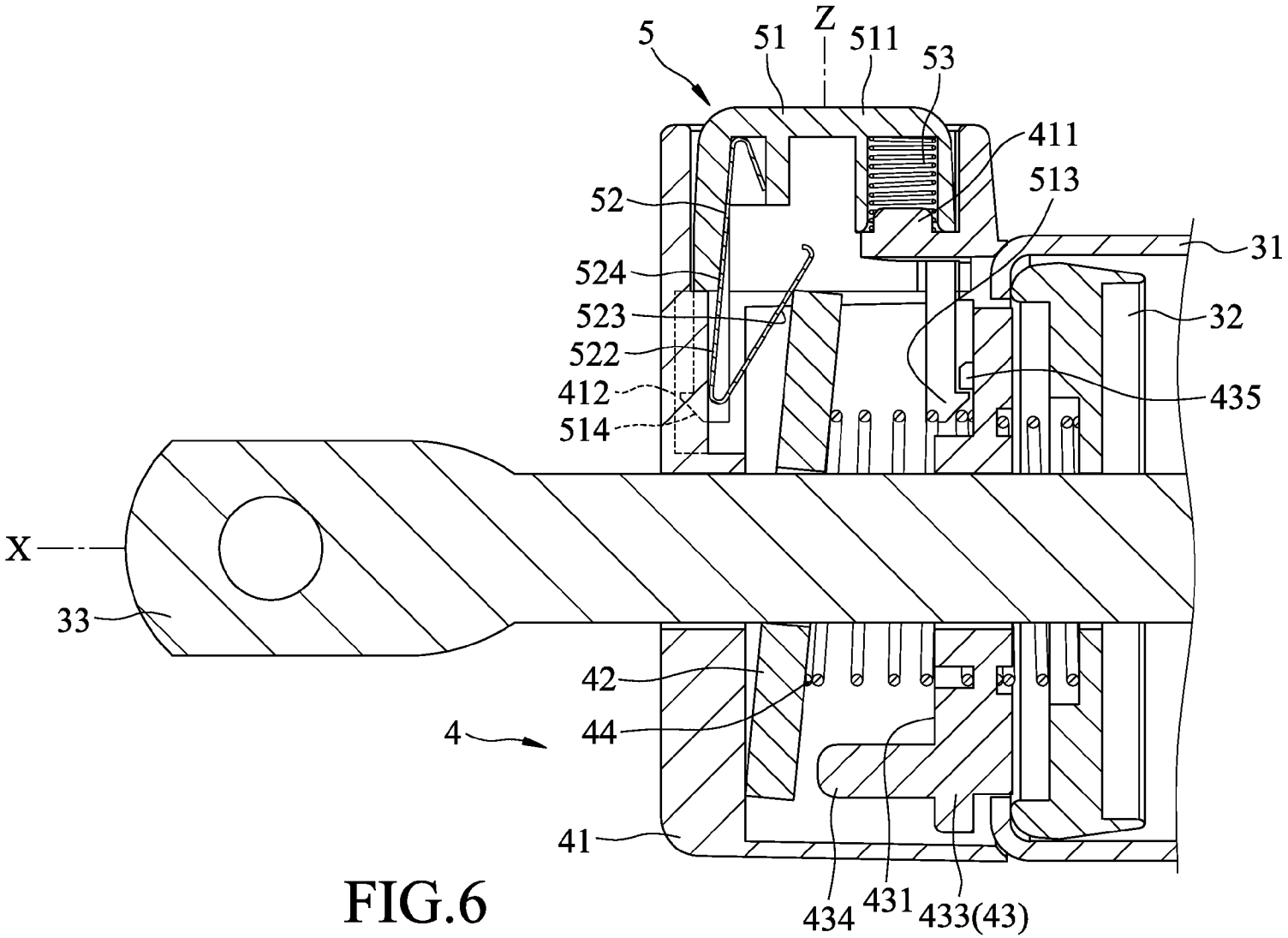
FIG. 6 is a view similar to FIG. 5, but illustrating the press unit in a pressed position.

The locking ring 42 is movable between an inclined position, as shown in FIG. 6, and a non-inclined position, as shown in FIG. 5. In the inclined position, the locking ring 42 is oblique to and engages the piston rod 33. In the non-inclined position, the locking ring 42 disengages the piston rod 33.

Figure 8:
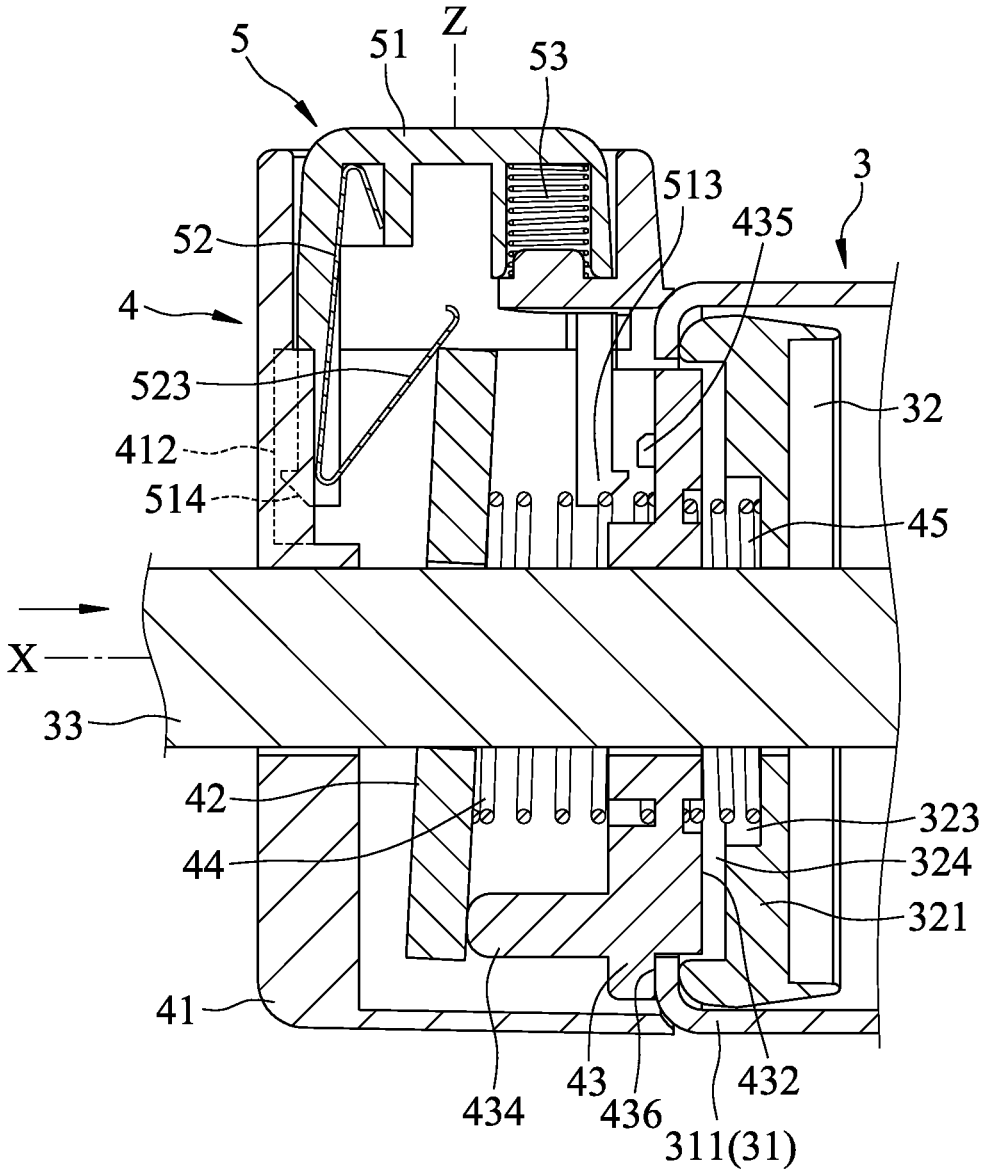
FIG. 8 is a view similar to FIG. 7, but illustrating how the locking ring is moved to an inclined position when the piston rod is pulled into the cylinder.

The abutment member 43 includes a disc-like main portion 433 disposed around the piston rod 33 and having opposite first and second abutment surfaces 431, 432, and an annular stop surface 436 surrounding the second abutment surface 432. An abutment element 434, in the form of a finger, projects from the first abutment surface 431 toward the locking ring 42, and is spaced apart from the abutment arm 411. Two spaced-apart engaging portions 435 are provided on the first abutment surface 431 spaced apart from the abutment element 434. The second biasing member 45 has the one end stably disposed on the second abutment surface 432. The first biasing member 44 has one end stably disposed on the first abutment surface 431. As shown in FIG. 8, when the abutment member 43 is moved away from the locking ring 42, the second abutment surface 432 can extend into the receiving space 324, and the annular stop surface 436 can abut against the free end 311 of the cylinder body 31.

The press unit 5 includes a press button 51, a push member 52 and a third biasing member 53. The press button 51 is inserted into the first portion 413 of the casing 41, and is slidable along a transverse direction (Z) which is transverse to the longitudinal direction (X). The press button 51 has a press panel 511, a surrounding wall 512 extending from a periphery of the press panel 511 toward the piston rod 41, two spaced-apart first engaging hooks 513 extending from an edge of the surrounding wall 412 away from the press panel 511, and two spaced-apart second engaging hooks 514 extending from the edge of the surrounding wall 412 opposite to the first engaging hooks 513. The second engaging hooks 514 are respectively slidable in the slide grooves 412 to maintain the movement of the press button 51 along the transverse direction (Z).

The push member 52 includes a fixed section 524 having one end 521 engaged to the press button 51 and another opposite end 522 protruding from the press button 51, and a pushing section 523 extending obliquely from the end 522 of the fixed section 521. In this embodiment, the push member 52 is a spring plate, but it not limited thereto.

The third biasing member 53 has two opposite ends respectively abutting against the press panel 511 and the abutment arm 411. The third biasing member 53 is used to bias the press button 51 away from the abutment arm 411. It should be noted that the third biasing member 53 and the abutment arm 411 may be dispensed herewith. In this case, a restoring force of the pushing section 523 of the push member 52 may be used to move the press button 51 away from the locking ring 42.

In this embodiment, the press button 51 further includes spaced-apart first and second partition walls 515, 516 (see FIG. 5) extending from an inner surface of the press panel 511 toward the piston rod 33. The press panel 511 and the surrounding wall 512 cooperate with the first partition wall 515 to define a first chamber 517 for engagingly receiving the fixed section 524 of the push member 52, and cooperate with the second partition wall 516 to define a second chamber 518 for receiving the third biasing member 53.

With reference to FIGS. 5 and 6, the press unit 5 is movable along the transverse direction (Z) relative to the casing 41 between a pressed position (see FIG. 6) and an unpressed position (see FIG. 5). In the pressed position, each first engaging hook 513 is engaged to the respective engaging portion 435, each second engaging hook 514 is slid down along the respective slide groove 412, and the pushing section 523 of the push member 52 pushes one end of the locking ring 42 that is spaced apart radially from the piston rod 33 to move the locking ring 42 to the inclined position where the locking ring 42 compresses the first biasing member 44 against the abutment member 43. In the unpressed position, the locking ring 42 is in the non-inclined position, and the first engaging hooks 513 are disengaged from the respective engaging portions 435. Further, the second engaging hooks 514 respectively abut against ends of the slide grooves 412 that are distal from the piston rod 33 so as to prevent the press button 51 from being detached from the casing 41, and the pushing section 523 is spaced apart from the locking ring 42.

It is worth to mention that the press button 51 may be dispensed with the second engaging hooks 514 and only have one first engaging hook 513. In this case, the casing 41 is not provided with the slide grooves 412, and the abutment member 43 has only one engaging portion 435. The first engaging hook 513 is engaged to the engaging portion 435 when the press button 51 is in the pressed position. The effect of retaining the press button 51 in the pressed position may be similarly achieved.

In this embodiment, two opposite ends of the door closing device of this invention are installed on the door and the door frame, respectively. When the door closing device of this invention is not in use, the door is in a closed position, the press unit 5 is in the unpressed position, and the piston rod 33 and the locking unit 4 are in initial positions, as shown in FIG. 5.

To use the door closing device of this invention, that is, to open the door to a desired opening angle, the press button 51 is first pressed by a user along the transverse direction (Z), as shown in FIG. 6, until the first engaging hooks 513 are engaged to the respective engaging portions 435, and the pushing section 523 pushes the one end of the locking ring 42 to move the locking ring 42 to the inclined position. At this time, an inner periphery of the locking ring 42 is in contact with an outer periphery of the piston rod 33.

Figure 7:
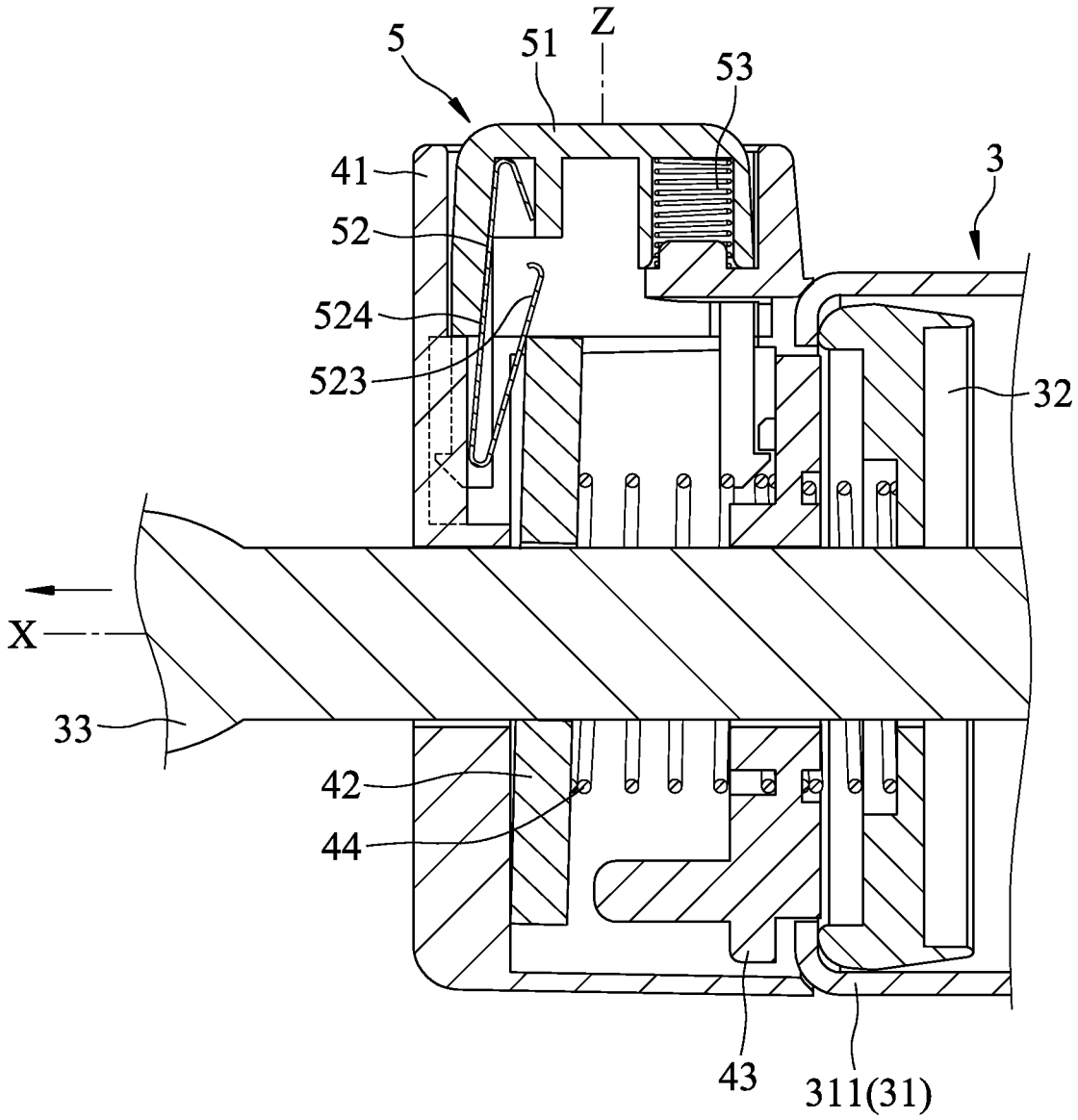
FIG. 7 is a view similar to FIG. 6, but illustrating a locking ring being biased away from an abutment member when a piston rod is pulled out of a cylinder.

Next, the user opens the door with his/her one hand, and, with reference to FIG. 7, the piston rod 33 is pulled outward in a direction away from the fixed end 312. Since the inner periphery of the locking ring 42 is in contact with the outer periphery of the piston rod 33, the locking ring 42 is moved by the piston rod 33 and is temporarily placed in the non-inclined position, so that the piston rod 33 can be easily pulled out to a desired position. At this time, the pushing section 523 is compressed by the locking ring 42, and a restoring force of the first biasing member 44 biases the locking ring 42 away from the abutment member 43.

Figure 9:
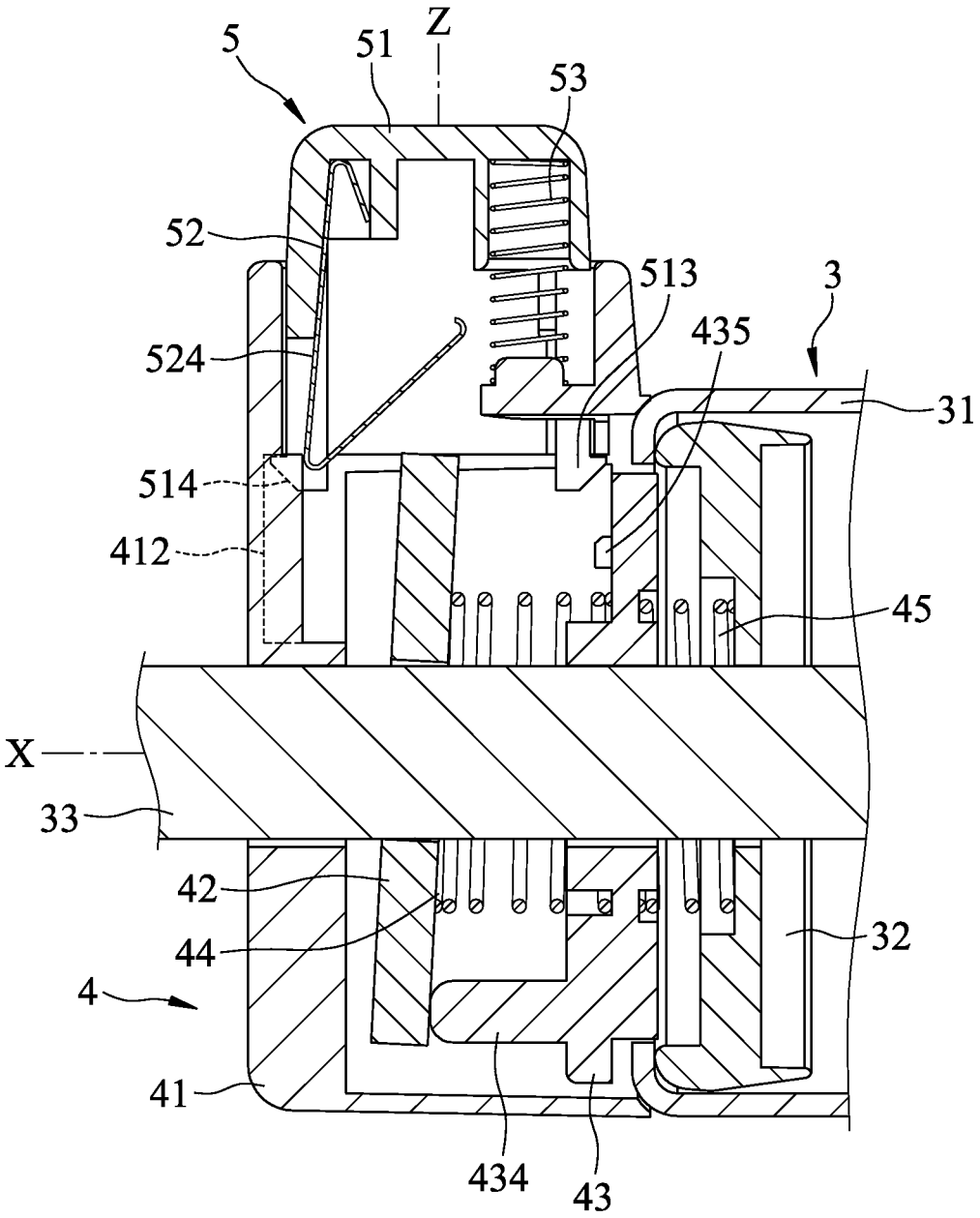
FIG. 9 is a view similar to FIG. 8, but illustrating the press unit being restored to the unpressed position and the locking ring being kept in the inclined position by a abutment element of the abutment member.

With reference to FIGS. 8 and 9, when the desired position of the piston rod 33 is reached or a desired opening angle of the door is obtained, the user's hand is released from the door, and the piston rod 33 is biased toward the fixed end 312 by a restoring force of a spring (not shown) provided inside the cylinder body 31. Simultaneously, the one end of the locking ring 42 is pushed by a restoring force of the pushing section 523 to move the locking ring 42 to the inclined position, the first biasing member 44 is compressed by the locking ring 42 against the abutment member 43, and the abutment member 43 is pushed by the first biasing member 44 to move away from the locking ring 42. As such, the engaging portions 435 are moved away from the respective first engaging hooks 513, and the press button 51 is pushed by a restoring force of the third biasing member 53, thereby returning the press unit 5 to the unpressed position. Further, the abutment member 43 is biased by the second biasing member 45 to move toward the locking ring (42) so as to abut the abutment element 434 against another end of the locking ring that is spaced apart radially from the piston rod 33 and that is opposite to the one end of the locking ring 42. Moreover, the second engaging hooks 514 are slid to abut against the ends of the slide grooves 412 that are distal from the piston rod 33, and the pushing section 523 is moved away from the locking ring 42. Because the biasing forces that are directly or indirectly applied to the locking ring 42 plus the frictional contact between the locking ring 42 and the piston rod 33 are larger than the restoring force of the spring provided in the cylinder body 31, the piston rod 33 cannot move further toward the fixed end 312, and is stopped and retained by the locking ring 42. Hence, positioning of the door at the desired opening angle can be easily accomplished.

Figure 10:
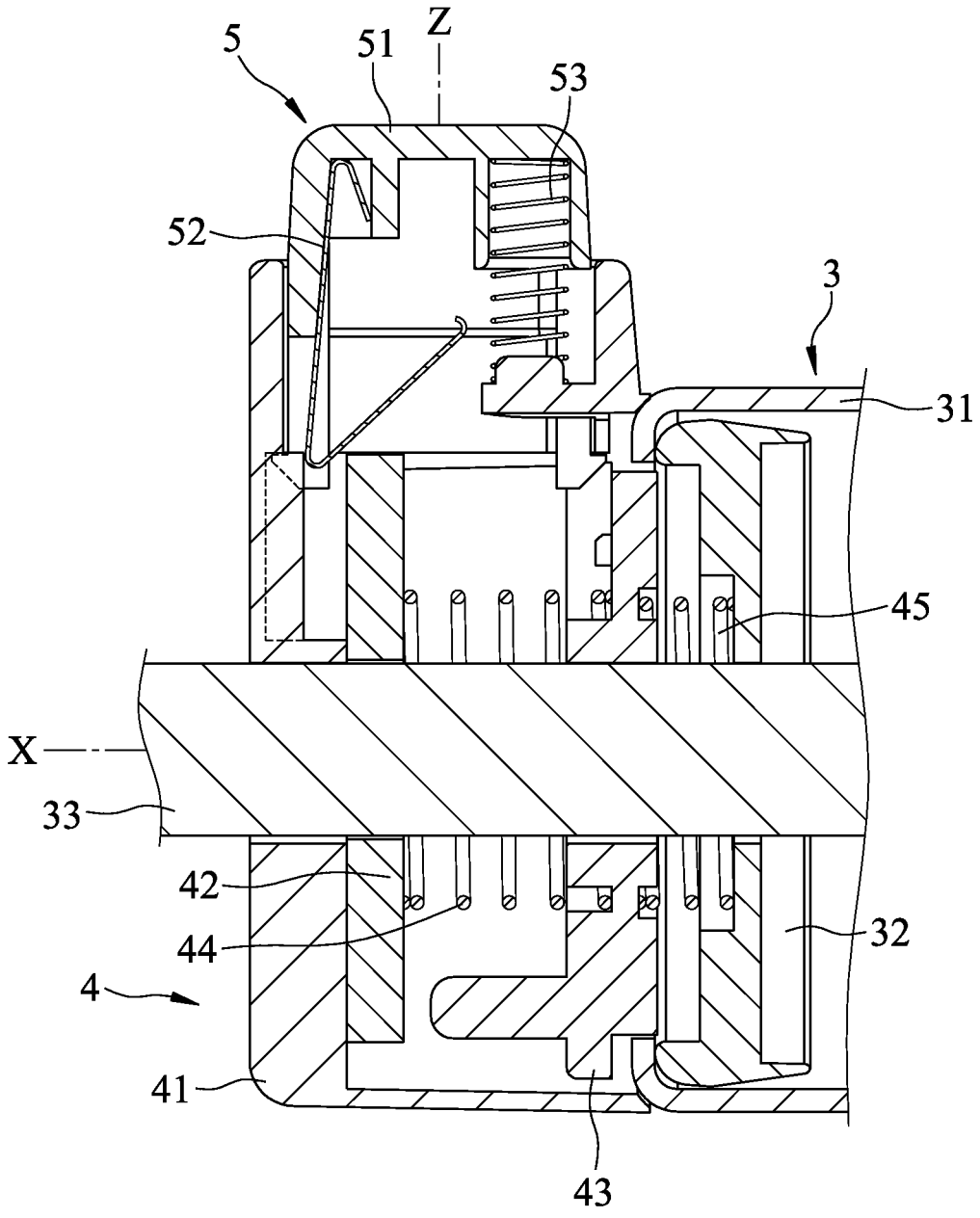
FIG. 10 is a view similar to FIG. 9, but illustrating the piston rod being restored to its original position.

With reference to FIG. 10, if it is desired to close the door, the door is lightly pushed so as to pull the piston rod 33 out of the cylinder body 31 again, and the locking ring 42 is moved by the piston rod 33. Through the restoring forces of the first and second biasing members 44, 45 that are respectively applied to the locking ring 42 and the abutment member 43, the locking ring 42 and the abutment member 43 are restored to their initial positions. Further, when the door is released, the piston rod 33 is restored to the initial position by the restoring force of the spring provided in the cylinder body 31.

From the aforesaid description, the advantages of this invention can be summarized as follows:

1. In using the door closing device of this invention, the press button 51 is first pressed, after which one hand of the user is used to open the door. The door is released after the desired opening angle is reached. Even if the user's hand is occupied, it cannot affect the opening/closing of the door.

2. The casing 41 of the locking unit 4 can accommodate the locking ring 42, the abutment member 43, and the first and second biasing members 44, 45, so that these components are not exposed, and injury to the user's hand may be avoided. Hence, the door closing device of this invention is safe to use.

3. To close the door, the door is lightly pushed. Hence, the door closing device of this invention can close the door automatically without using much effort.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A door closing device, comprising:

a cylinder including a cylinder body having a fixed end and a free end opposite to said fixed end, and a piston rod axially movable in said cylinder body and having one end extending out of said free end;

a locking unit including a casing disposed around said piston rod and on said free end of said cylinder body, and a locking ring and an abutment member both disposed in said casing, said locking ring being disposed around said piston rod and being movable between an inclined position, where said locking ring is oblique to said piston rod and an inner periphery of said locking ring engages said piston rod, and a non-inclined position, where said inner periphery of said locking ring disengages said piston rod; and a press unit disposed on said casing and movable between a pressed position, where said press unit presses said locking ring to move to said inclined position, and an unpressed position, where said press unit moves away from said locking ring;

wherein said abutment member is able to abuts against said locking ring to keep said locking ring in said inclined position when said press unit is in said unpressed position;

wherein said press unit includes a press button slidably disposed on said casing, and a push member that protrudes from said press button, that pushes one end of said locking ring which is spaced apart radially from said piston rod when said press unit is in said pressed position, and that does not push said one end of said locking ring when said press unit is in said unpressed position, said abutment member including an abutment element that is biased to move toward and abut against another end of said locking ring which is spaced apart radially from said piston rod and which is opposite to said one end of said locking ring in order to place said locking ring in said inclined position when said push member does not push said one end of said locking ring and when said press unit is in said unpressed position.

2. The door closing device of claim 1, wherein said push member is a spring having a pushing section to push said one end of said locking ring to said inclined position when said press unit is in said pressed position, said pushing section moving away from said locking ring when said press unit is in said unpressed position.

3. The door closing device of claim 1, wherein said locking unit further includes a first biasing member disposed between said abutment member and said locking ring for biasing said locking ring away from said abutment member, and a second biasing member disposed between said cylinder body and said abutment member and opposite to said first biasing member for biasing said abutment member toward said locking ring.

4. The door closing device of claim 3, wherein said abutment member further includes a disc-like main portion disposed around said piston rod and having opposite first and second abutment surfaces, said abutment element projecting from said first abutment surface to abut against said locking ring when said press unit is in said unpressed position, said first biasing member abutting between said locking ring and said first abutment surface, said second biasing member abutting between said cylinder body and said second abutment surface.

5. The door closing device of claim 4, wherein:

said abutment member further includes an engaging portion disposed on said first abutment surface in proximity to said press unit, said press button having a press panel, a surrounding wall extending from a peripheral end of said press panel toward said piston rod, and a first engaging hook extending from an edge of said surrounding wall away from said press panel and releasably engaging said engaging portion when said press unit is in said pressed position.

6. The door closing device of claim 5, wherein said cylinder further includes a support member disposed in said free end of said cylinder body, and said second biasing member abuts between said second abutment surface and said support member.

7. The door closing device of claim 6, wherein said support member has a main body, and two spaced-apart support posts projecting from said main body toward said casing, so that said abutment member, said locking ring and said casing are supported on said support posts, said second biasing member abutting between said second abutment surface and said main body, said main body having a through slot for extension of said piston rod therethrough, and a receiving space communicating with said through slot for receiving a portion of said abutment member when said abutment member is moved toward said fixed end of said cylinder body.

8. The door closing device of claim 7, wherein said abutment member includes two said engaging portions, said press button having two said first engaging hooks, said first engaging hooks respectively engaging said engaging portions when said press unit is in said pressed position, and respectively disengaging from said engaging portions when said press unit is in said unpressed position.

9. The door closing device of claim 7, wherein said press button further has two second engaging hooks extending from said edge of said surrounding wall opposite to said first engaging hooks, said second engaging hooks abutting against said inner surface of said casing when said press unit is in said unpressed position.

10. The door closing device of claim 9, wherein said casing has two spaced-apart slide grooves formed in said inner surface thereof, said second engaging hooks respectively abutting against ends of said slide grooves that are distal from said piston rod when said press unit is in said unpressed position.

11. The door closing device of claim 9, wherein said press unit further includes a third biasing member disposed between said press button and said casing for biasing said press button to said unpressed position.

12. The door closing device of claim 10, wherein said casing has an abutment arm extending inwardly from said inner surface thereof, and said third biasing member is disposed between said press button and said abutment arm.

* * * * *